United States Patent [19]

Mendenhall

[11] 3,975,002

[45] Aug. 17, 1976

[54] PROCESS AND APPARATUS FOR RECYCLE OF ASPHALT-AGGREGATE COMPOSITIONS

[76] Inventor: Robert L. Mendenhall, 1770 Industrial Road, Las Vegas, Nev. 89102

[22] Filed: July 12, 1974

[21] Appl. No.: 487,911

Related U.S. Application Data

[62] Division of Ser. No. 286,613, Sept. 5, 1972.

[52] U.S. Cl. ..... 259/148; 259/157; 432/112

[51] Int. Cl.[2] ..... B28C 5/00

[58] Field of Search ..... 259/148, 155, 156, 157, 259/158, 3, 176, 177 R, 177 A; 432/112; 34/39

[56] References Cited

UNITED STATES PATENTS

| | | | |
|---|---|---|---|
| 1,189,772 | 7/1916 | Ammann | 259/156 |
| 1,774,649 | 9/1930 | Hepburn et al. | 259/148 |
| 2,715,517 | 8/1955 | Bojner | 259/157 |
| 3,279,892 | 10/1966 | Lesser et al. | 432/112 |
| 3,840,215 | 10/1974 | McConnanghay | 259/158 |

*Primary Examiner*—Richard E. Aegerter
*Attorney, Agent, or Firm*—Jerry R. Seiler

[57] ABSTRACT

A process for recycling asphalt-aggregate compositions comprises heating pieces of the used composition to form a semifluid or viscous composition, detecting the composition's asphalt deficiency and adding the proper amount of make-up asphalt. The composition is heated in a rotating cylindrical oven to achieve homogeneity, the viscous composition is drawn off, detected for asphalt deficiency, the proper amount of asphalt is added and the composition is then stored until required for use. Asphalt deficiency is detected by exposing the composition to a light source and measuring the amount of light reflected.

3 Claims, 5 Drawing Figures

PROCESS AND APPARATUS FOR RECYCLE OF ASPHALT-AGGREGATE COMPOSITIONS

This is a division of application Ser. No. 286,613 filed Sept. 5, 1972.

BACKGROUND OF THE INVENTION

Asphalt-aggregate compositions have found great success in road construction and particularly high quality road surfacing. For example, asphaltic concrete is an especially useful and widely used composition consisting of carefully proportioned mix of course and fine aggregate, and mineral filler where required, coated with asphalt. The composition provides a surfacing of exceptional durability and is widely used for heavily trafficked roads, airfield runways and the like for all types of climatic conditions. The composition is laid and compacted while still hot, normally in two or three layers where thick surfacing is required or in a single course for resurfacing.

Although such asphalt-aggregate compositions yield roadways having relatively long life, and which may easily be resurfaced for increased longevity, old roadways become abandoned from time to time due to new highway construction. In other circumstances old asphaltic concrete surfaces may be removed and the road base reworked or improved and a new surface laid, or parking lots removed for buildings. In any of such cases, it is common practice to simply tear up the old asphaltic concrete surface and haul it away to a dump or other remote location. Yet, such used asphalt-aggregate composition are seemingly indestructable and will not deteriorate substantially even after many years. Further, the old compositions still contain substantially all of the asphalt of the original composition as well as the aggregate although some aggregate sizes may have changed somewhat due to fracturing over years of use. Some additional aggregate in the way of sand or rock may also be present.

Costs involved in removing the old discarded road surface materials to dump sites are high due to the bulk and weight. Moreover, large areas may be required for dumping the accumulated and non-deteriorating material. In addition, such disposal sites are most unsightly. In other words, the abandonment of asphalt-aggregate compositions is simply contrary to good ecology practice as well as a waste of valuable natural resources. Accordingly, it is considered most desirable to attempt to recycle and reuse the compositions containing both mineral aggregates and petroleum or natural asphalt. It is to the elimination of waste of such resources as well as in the interest of ecology and as an important advance in the continuing extensive and costly roadway construction that the present invention is directed.

SUMMARY OF THE INVENTION

The concept of the present invention takes advantage of reusing and recycling old asphalt-aggregate compositions which have traditionally been discarded and dumped and which compositions contain the essential and expensive aggregate and asphalt ingredient required to form new road surface material compositions. The invention comprises a method of recycling the asphalt-aggregate compositions, a heat apparatus for treating the compositions during the process as well as an asphalt deficiency detection means.

The process for treating the old asphalt-aggregate compositions comprises heating composition pieces at a temperature and for a time sufficient to form a semi-fluid composition, passing the composition through an asphalt deficiency detecting phase and thereafter adding the proper amount of make-up asphalt.

The heating apparatus comprises an elongated cylindrical heating chamber having a plurality of heating tubes extending the interior chamber length and means for heating the tubes, preferably using hot air heating means. The composition is placed in one end of the cylindrical heating chamber and recovered from the other end in a semi-fluid homogeneous and hot state.

Asphalt deficiency detection comprises exposing the composition to a light source and detecting reflected light by photo-electric means. The amount of reflected light indicates the amount of aggregate surface exposed which has not been covered by asphalt and is thus proportional to the asphalt deficiency.

DETAILED DESCRIPTION OF THE INVENTION

Recycling Process

Figure 1:
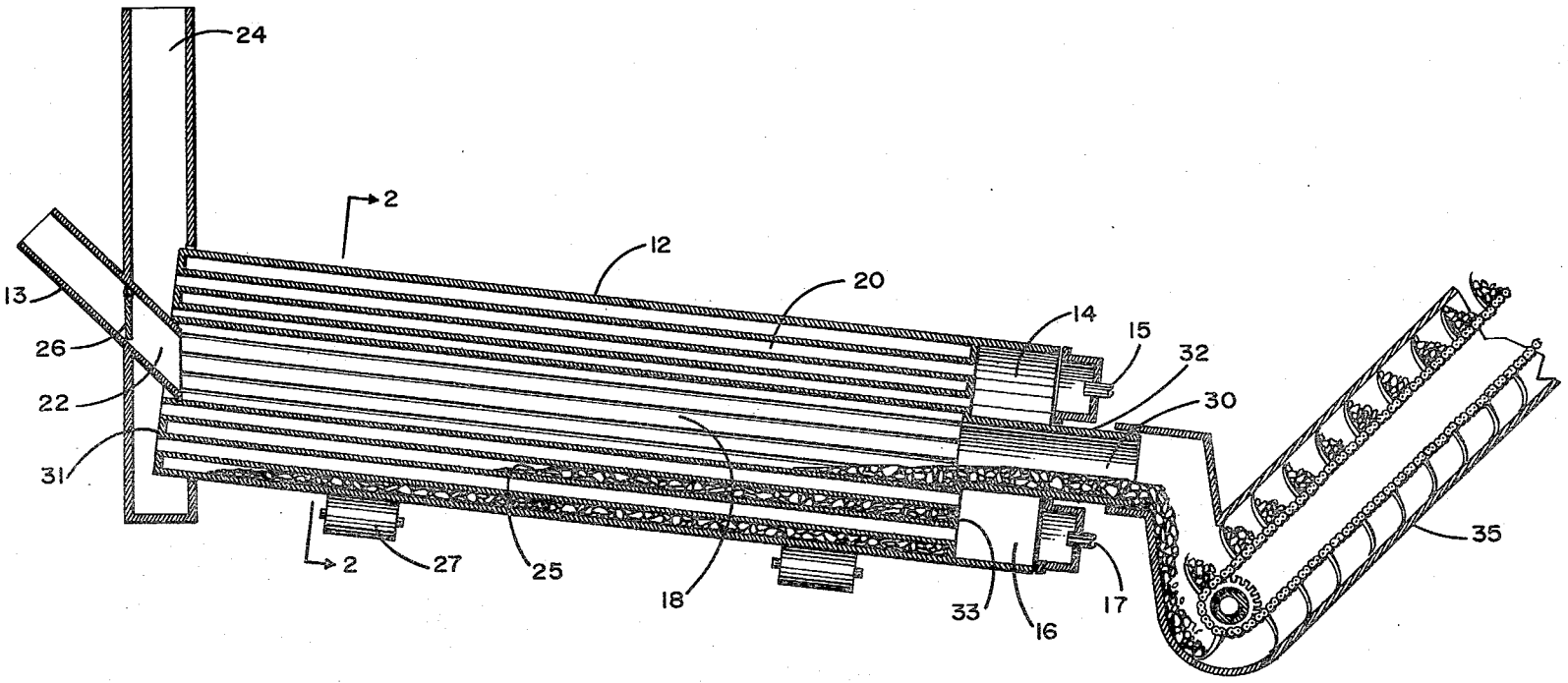
FIG. 1 is a side sectional elevation of a heating apparatus according to the invention.

Initially it will be appreciated that asphalt-aggregate compositions obtained from old road surface contain the two valuable, expensive and substantially non-degradable resources, ashalt and aggregate. Although such composition may have lost small amounts of original asphalt, due to some deterioration or degradation, this valuable component whether it be natural bitumen or petroleum asphalt, as is normally used in this country, is present in substantial amounts. The compositions to be recycled will have between about 1 and about 10% asphalt by weight with the remainder being aggregate. Moreover, because of the exposure and use to which the composition has been subjected on a road surface, the materials have actually aged so that imperfections in aggregates have resulted in some fracturing whereas the asphalt has also become consolidated and more completely wetted the aggregate surfaces. Thus, the composition because of its aging has actually been improved somewhat over a newly formed and mixed composition so that further physical changes when treated and reapplied for a road surface will be minimized as compared to a freshly mixed composition of previously unused asphalt and aggregate.

Recovered asphalt-aggregate compositions to be recycled according to the invention may consist of used road surface materials having those ingredients such as asphalt or bitumen macadam products, cold or hot asphalts or asphaltic concrete, the latter being more extensively used in this country for heavy duty road surfacing. As used hereinafter, the term asphalt-aggregate composition shall mean any of these materials and is not to be so limited as will be understood by those skilled in the art. Again, the compositions will normally have an asphalt: aggregate ratio of between about 0.1:10 and about 1:10 by weight. The compositions may be obtained directly from an old road runway or parking lot surface which has been broken up into slabs or chunks or from a dump site or other accumulation point. Although such materials may be somewhat contaminated, the contamination usually consists only of additional aggregate-type materials such as sand, rock or other mineral materials which will not substantially affect the process of the invention. Indeed, where road base aggregates are also present, such aggregates are valuable and once properly sized during the process are readily used in the recycled composition.

The salvaged pieces or chunks and slabs of used asphalt-aggregate materials are irregular and odd shaped, normally having approximately the same thickness of the original pavement or surface. These slabs or chunks are then treated in a conventional rock crusher of sufficient size to accomodate the pieces so that the material to be processed according to the invention will pass through an approximately one inch screen. The screen size is not particularly critical except that where all of the crushed materials will pass through about a one inch screen size it will be relatively easy to handle and process. Moreover, unduly large aggregate pieces which would affect the homogeneity of the road surface composition are removed. The crushing or grinding phase of the process will also fracture cracked or weak aggregate materials which is desirable at this point whereby further fracturing of the aggregate once it has been applied as a new road surface is less likely to occur. The screen sized composition is then transported or placed into a feeder for measured delivery to a heating apparatus.

HEATING PROCESS AND APPARATUS

Referring now to FIG. 1, there is shown in section a type of heating apparatus that is preferably used in recycling the asphalt-aggregate materials. The material placed on chute 13 passes through input port 22 from a feeder following the crushing phase as previously noted. The chute is located at one end of the heating apparatus. At the opposite end is an outlet port 30 from which the heated composition is drawn and thereafter directed to subsequent processing via conveyor apparatus 35.

Figure 2:
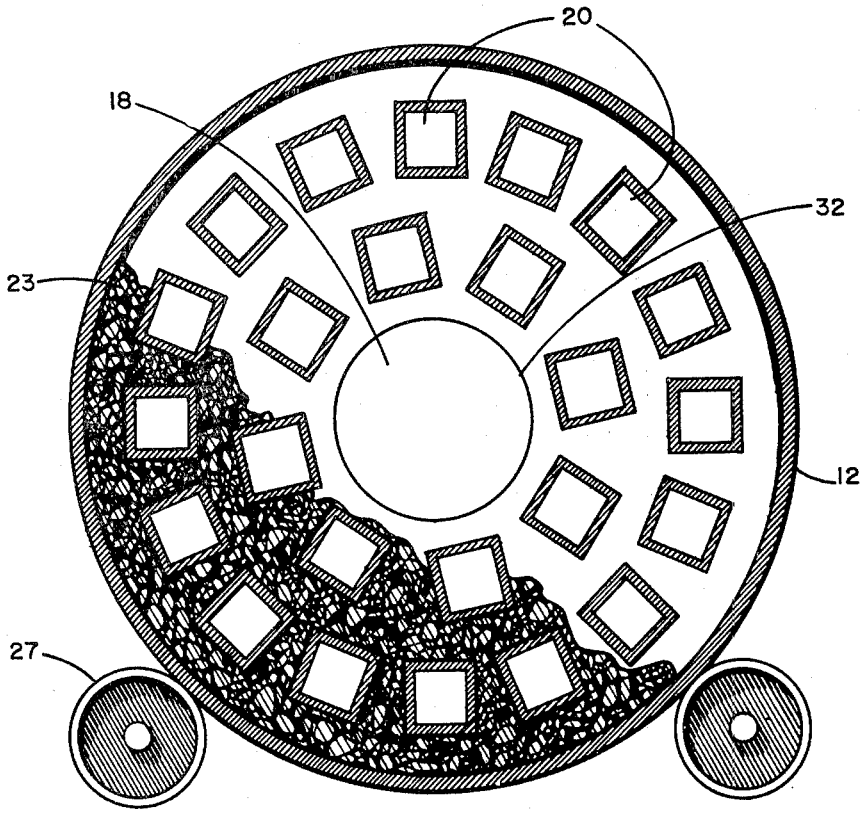
FIG. 2 is a sectional elevation of the heating apparatus taken along lines 2—2 of FIG. 1.

Referring also to FIG. 2, the heating apparatus comprises an elongated cylinder 12 which is generally hollow except for heating tubes 20 extending along the length of the interior heating chamber 18. Adjacent material input port 22, which may be in the form of any channel for delivering the composition into the heating apparatus, is an end wall 31. At the opposite end adjacent outlet port 30 is an end wall 33. These opposite walls enclose interior heating chamber 18 except for the port openings 22 and 30 described.

At the end opposite input port 22 of the heating apparatus are located the heat producing means which supply heat to heat tubes 20. The heating means may be any suitable type readily available for such an apparatus and are preferably hot air producing such as gas or low pressure oil burners, nozzles 15 and 17 of which are illustrated in FIG. 1. Other details of such burners are well known to those skilled in the art and will not be further described as part of the present invention except as they are to be installed on a heating apparatus of the type described herein. The heater flame producing nozzle 15 and 17 will produce a hot flame projected into heating cavities 14 and 16 respectively which cavities are in communication with hollow heat tubes 20.

Although the two nozzles 15 and 17 are illustrated, the number of heaters is not particularly critical so long as sufficient energy is provided to adequately heat the asphalt-aggregate composition to the necessary extent and within reasonable time periods. Accordingly, the number and capacity of the heaters installed in a heating apparatus of the type described will depend on the rate at which materials are to be heated and removed from the apparatus, the size of the heating chamber, its efficiency, number of heat tubes, etc. Again, such considerations are not critical so long as the asphalt-aggregate compositions can be sufficiently heated to a viscous or semi-fluid condition above about 225°F and preferably above about 300°F and more preferably about 325°F. For example, another heating means could comprise electric heat strips along the heat tubes or hot water could be passed along the heat tubes. These as well as other equivalent heating means may be used rather than the hot air means described.

Figure 3:
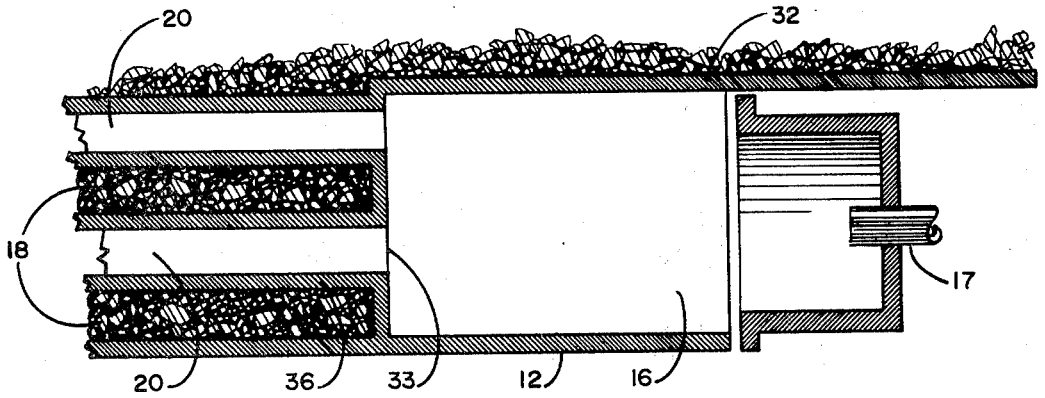
FIG. 3 is an exploded partial sectional elevation of the hot air producing means and heating tubes of the apparatus of FIG. 1.

Observing also FIG. 3, it will be noted that a heating cavity 16 adjacent nozzle 17 communicates directly with the interior of hollow heat tubes 20. Both ends of the heating tubes are open similar to that shown in FIG. 3. End wall 33 encloses interior heating chamber 18 of cylinder 12 on the one end while a substantially identical wall 31 encloses the other chamber end, again, except for inlet and outlet ports.

Heating tubes 20 extend substantially along the interior length of heating chamber 18 between walls 33 and 31 and may be circular, square, rectangular or other shape in cross section. The shape which offers the greatest amount of exterior surface contact with asphalt-aggregate compositions to be heated are preferred. Square cross-section heating tubes 20 shown in FIG. 2 give approximately 25% more surface area than round heating tubes and are relatively stronger. The heating tubes should also have relatively thin walls to provide for more rapid and efficient heat transfer to a composition 23 shown in FIG. 2 within heating chamber 18.

In a preferred embodiment, the heater apparatus is tilted as shown in FIG. 1 so that input port 22 is elevated above the output port 30. Moreover, in this preferred embodiment, the heating apparatus is rotated so that cylinder 12 rotates about the elongated axis thereby providing a tumbling or cascading effect of the asphalt-aggregate composition being heated therein. At the same time the composition is being advanced downwardly by gravity toward outlet port 30. Thus, in operation, cool aggregate as previously described is placed in the heating apparatus at input port 22 wherein it is directed to interior heating chamber 18. Heaters 15 and 16 provide hot air heating tubes 20 which hot air is forced therealong toward the opposite end of the heating tubes. Since the tubes are open ended and are in contact with the composition they gradually cool somewhat along the heating tube length. An exhaust means for the hot air is provided by exhaust tube or chimney 24 so that the somewhat cooled but still warm air may be vented out of the apparatus at the opposite end. As cylinder 12 is rotated, the asphalt-aggregate material will be tumbled within heating chamber 18 between the hot long hollow heating tubes 20. Again, the temperature of the heating tubes will likely be less at the cool end near inlet port 22 because some heat will have been transferred in heating the composition nearer heating cavities 14 and 16 which may be referred to as the hot end of the apparatus.

As the tumbling action occurs, since the cylinder is tilted with the hot end being lower than the cool end, the composition will advance at its own rate toward the hot end outlet port 30 as it becomes more heated to gradually increasing temperatures. Moreover, the consistency of the composition will change gradually as its temperature rises so that by the time it arrives to outlet port 30, the composition should have achieved its temperature of above about 225°F, preferably above 300°F and more preferably about 325°F. At such temperature, the composition will become viscous or semi-fluid due to the thermoplastic nature of the heated asphalt. Moreover, the composition should be quite homogeneous because of the significant mixing which has been achieved by the tumbling action caused by the rotating cylinder. Thus, such a preferred heating apparatus embodiment offers significant advantages in both heating and mixing the composition.

It is also preferred to heat the asphalt-aggregate composition without substantial oxygen circulation which would cause oxidation of the heated asphalt resulting in reduction of the asphalt penetration value and variation of its flow characteristics. Accordingly, inlet port 22 is preferably provided with a closure member 26 which may be biased so that it will only be opened when composition is being placed into the heating chamber. The closure member is also preferably open only during composition addition so as to not allow a draft to occur between inlet and outlet ports 22 and 30. This feature will prevent undue amounts of fresh oxygen containing gases or air to enter the heating chamber. To further avoid asphalt oxidation, the interior heating chamber could be purged with inert, reducing or non-oxidizing gases or the exhaust gases from the input end could be continually recycled or recirculated into the chamber. A screw-type feeding apparatus may also be used to direct compositions to the heating chamber 26 which would also further reduce the port opening and minimize oxidation. Other components may be installed for that purpose.

Asphalt burning or flashing of its more volatile components are avoided since the compositions are not exposed to direct flame. This can be appreciated in noting particularly FIG. 3 in which a flame extending from heating nozzle 17 and directed into heating cavity 16 does not come in contact with the interior of heating chamber 18 but instead passes along heating tubes 20. In other words, the asphalt-aggregate composition contacts only exterior walls of the heating tubes and even then is heated only gradually from the cool end to the hot end of the heating apparatus. The avoidance of direct contact of the composition with flame or extremely hot air from the heat source to prevent burning or loss of light volatiles is an important aspect of the heating equipment design.

Enough composition should be fed into the heating chamber at one time to provide for a gradual and continuing flow of properly heated composition to outlet port 30. Thus, measured and controlled input amounts will yield a continual flow of properly heated composition at outlet port 30. Line 25 illustrates an approximate level of composition which may be maintained for continually drawing off product at outlet port 30. Noting again FIGS. 1 and 3, undue heat buildup in the heating tubes may be prevented by the embodiment shown wherein cylinder 12 and attached heating tubes rotate independently from the heaters. Thus, heating cavity 16 is continually presented to a flame from heater nozzle 17 although different heating tubes will be continually exposed to the hot gas from the nozzle as the cylinder rotates. The amount of heat directed into the heating tubes can also be controlled by varying the rate of rotation of the apparatus which may be installed along the interior of heating chamber 18. Sensing probes or other heat sensing means may be used and which may control the number of heaters or burners being fired or the amount of heat input. Further composition temperature control may be achieved by changing the angle of tilt or inclination of the heating assembly.

Any means of rotating cylinder 12 may be utilized as desired as will be appreciated by those skilled in the art with rotating rollers 27 illustrated generally in FIGS. 1 and 2 by way of example. FIG. 2 further illustrates a level of composition 23 as the cylinder 12 is rotated clockwise and viewed toward funnel 32 (note also FIGS. 1 and 3) over which the composition is drawn through outlet port 30.

Once the viscous, molten or semi-fluid heated composition is at a sufficient level and temperature at the hot end of the heating apparatus, it is ready to be drawn out for further processing. Noting first FIG. 1, this will be accomplished when the level of sufficiently heated composition is high enough to be drawn into port 30, over funnel 32 and where it may be picked up by conveyer apparatus 35 or other suitable means for transporting it to the next phase of the process. Again, the temperature of the composition will be above about 225°F, preferably above about 300°F and more preferably at about 325°F or so as it leaves the heating chamber. Further, as previously noted and as will be evident, the composition will be quite homogeneous because of its extensive mixing by tumbling or cascading agitation over the heating tubes within the heating chamber as previously described. Conveyer system 35 is preferably closed to retain as much heat as possible in the hot composition. Heat losses should be minimized prior to final mixing of the composition with further make-up asphalt which will make mixing of the hot components at relatively the same or near heated temperatures more efficient.

Figure 4:
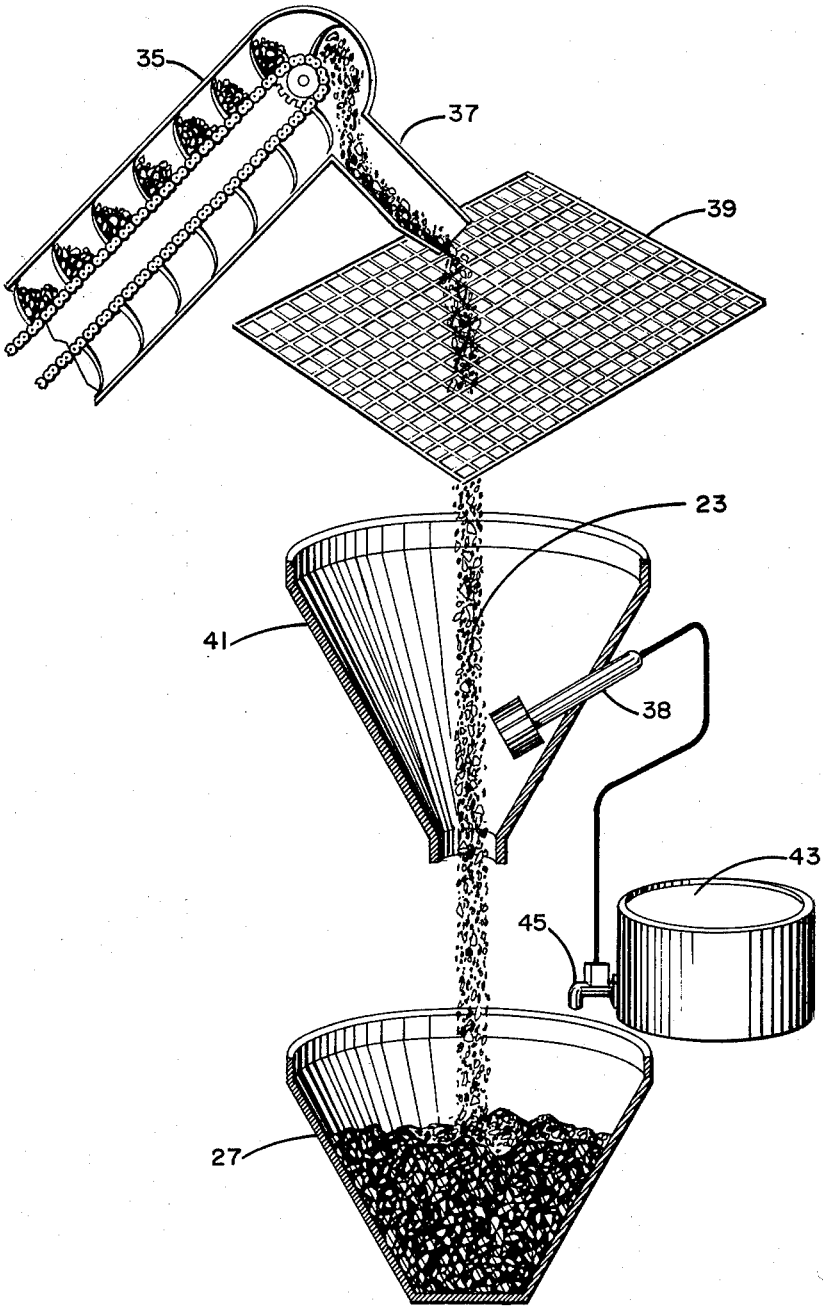
FIG. 4 is a schematic view of screen sizing, asphalt detection and asphalt addition steps and apparatus used in the process of the invention.

Referring to FIG. 4, the heated composition is then directed via chute 37 to screening apparatus 39 illustrated schematically in FIG. 4. Any conventional screening process and apparatus may be used, for example, as is commonly found in a pugmill, commonly used in manufacture of hot-mix asphalts. The purpose of the screening process is to separate the composition into different size batches of aggregate material which may be for example 1½ inch, ½ to ¼ inch and less than ¼ inch. The three batches sizes are then directed to asphalt quantity detection phase of the process.

ASPHALT DETECTION

Figure 5:
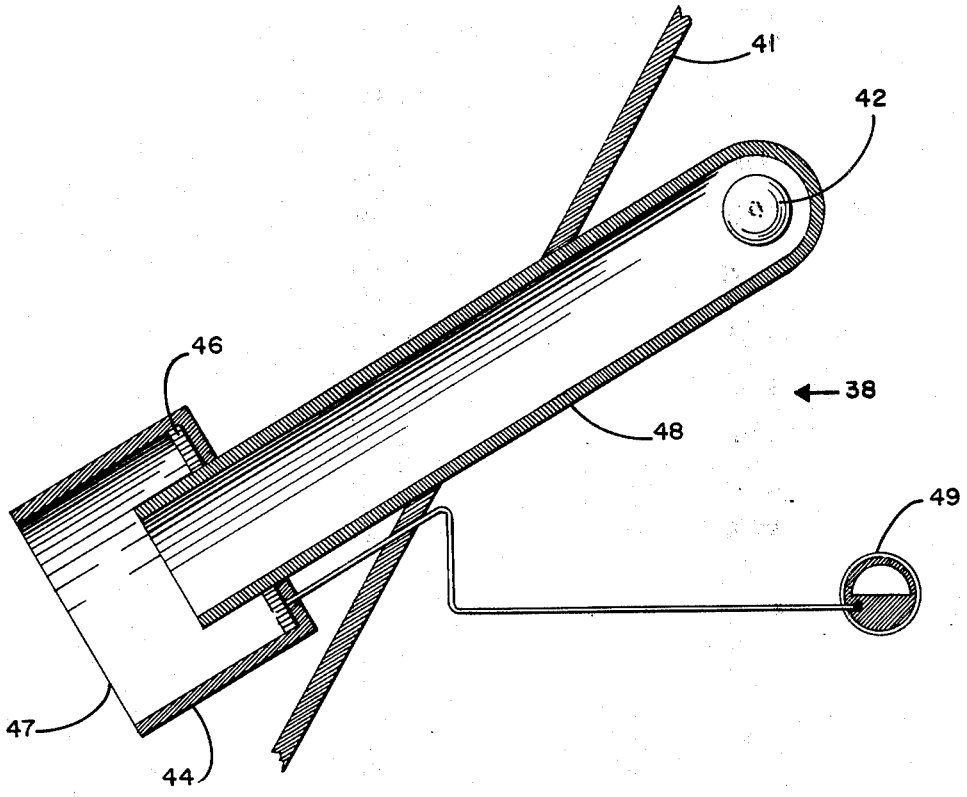
FIG. 5 illustrates an embodiment of asphalt detection apparatus in section.

The asphalt detection phase is schematically shown in FIG. 4 with example apparatus illustrated in FIG. 5. A stream of asphalt-aggregate composition 23 is passed through funnel 41 having a detection apparatus 38. Referring particularly to FIG. 5, detection apparatus 38 shown in sectional elevation comprises a light producing member or source 42 and photo-electric cell or similar light sensitive detecting means 46. In operation, light source 42, which may be a bulb and produce a light which can be reflected and detected from aggregate surfaces, will direct light toward aperture 47. This light will illuminate the particles of the composition passing before or in front of aperture 47. Since much of the composition will be black because of the substantial amount of asphalt present, little light will be reflected. However, the amount of reflected light will be detected by photo-electric cell 46 and may be transmitted to a meter 49 which will indicate the ratio of aggregate to asphalt. For example, the more asphalt present in the composition, the less the amount of reflected light to be detected by photoelectric cell 46. On the other hand, the less asphalt present, the more aggregate surfaces exposed so that more light will be reflected and be detected by the device. In the embodiment shown, the device is constructed so that light illuminated by light source 42 will pass along the narrower neck portion 48 and thereafter outwardly into expanded portion 44 without directly shining on photo-electric cell 46 which is inset and protected against direct illumination. However, this particular construction is by way of illustration only and not intended to be limiting to the type of detection apparatus which may be used so long as the desired function is achieved.

Referring again also to FIG. 4, asphalt detection means 38 may be connected to a control apparatus associated with asphalt tank 43 and asphalt delivery means 45 so that asphalt deficiency and make-up amounts can be directly added to the asphalt delivered in a storage vessel 27. It will be appreciated by those skilled in the art such a detection device may be callibrated and used with other monitoring and control equipment to achieve automatic addition of proper amounts of asphalt from an asphalt tank 43 and delivery means 45 in response to the detection apparatus and light reflected from a composition as previously described. However, manual make-up asphalt delivery means may be used whereby an operator in response to readings of reflected light of the described device may add indicate amounts of asphalt.

The make-up asphalt will be added while hot, preferably about 225°F depending on the type of specific asphalt material used so that it will be in a fluid state and can be easily mixed with the still hot recycled asphalt-aggregate composition. The materials are then further mixed in vessel 27 or similar device to achieve the final desired homogeneity for direct use as road surfacing composition. However, it should be appreciated that vessel 27 is shown only for purpose of illustration and any other suitable type of device may be used such as a conventional pugmill. It should also be appreciated that the heated composition drawn from the heating apparatus may be stored between the screening asphalt detection and asphalt make-up addition phases of the described process for any length of time. However, it will be preferred that during such storage the composition will be maintained at an elevated temperature so that it will remain semifluid and not become hardened whereby adequate mixture with make-up asphalt would become more difficult to achieve.

A further embodiment or modification of the process is asphalt detection and addition of make-up asphalt in the heating and mixing chamber itself. Accordingly, the asphalt detection phase previously described may be accomplished within the heating chamber and apparatus shown in FIG. 1 and the make-up asphalt added in the same chamber as the composition is heated and mixed. Such an embodiment will further reduce equipment costs and requirements and is particularly advantageous where higher quality and carefully sized aggregate composition are not of primary importance.

It will be evident that the process herein described as well as the apparatus allows for recycle of valuable used asphalt-aggregate composition. The process is relative simple, requiring only adequate apparatus to achieve the desired heating and make-up asphalt detecting phases. Not only does such a method yield an asphalt which is highly practical from an economical standpoint since it utilizes asphalt and aggregate without further depleting those natural resource materials, but also, if extensively used, prevents substantial accumulation of old asphalt-aggregate compositions which are unsightly, expensive to dump or otherwise discard. These as well as other advantages will be evident to those skilled in the art.

I claim:

1. In a process for treating asphalt-aggregate compositions by mixing and heating the composition in an elongated tilted rotatable cylindrical drum having an input end and an opposite output end and a plurality of pipes extending along the length of the drum interior and means for providing hot gases of combustion to the pipes, the improvement of recycling used asphalt-aggregate compositions comprising:

introducing said composition comprising asphalt and aggregate in said drum at the input end, mixing and gradually heating said composition to a temperature above 225°F by rotating said drum while supplying said hot gas into said pipes and exposing said composition to said pipes and out of direct contact with said hot gas while said composition is advanced gravitationally along said drum toward the output end, and recovering the heated composition at the output drum end.

2. The method of claim 1 wherein said composition is heated up to 325°F.

3. The method of claim 1 including preventing a draft of oxygen containing gas in said drum interior.

* * * * *